US008664501B2

(12) United States Patent
Miele et al.

(10) Patent No.: US 8,664,501 B2
(45) Date of Patent: Mar. 4, 2014

(54) VOCAL TUNING DEVICE FOR MICROPHONES

(75) Inventors: Jack J. R. Miele, Metairie, LA (US); Chad D. Gilmore, Metairie, LA (US)

(73) Assignee: JCT Products, LLC, Houma, LA (US)

( * ) Notice: Subject to any disclaimer, the term of this patent is extended or adjusted under 35 U.S.C. 154(b) by 790 days.

(21) Appl. No.: 12/407,373

(22) Filed: Mar. 19, 2009

(65) Prior Publication Data

US 2010/0236380 A1 Sep. 23, 2010

(51) Int. Cl.
*G10G 7/02* (2006.01)

(52) U.S. Cl.
USPC ..... 84/454; 84/609; 84/616; 84/649; 84/654; 84/723

(58) Field of Classification Search
USPC ..... 84/454
See application file for complete search history.

(56) References Cited

U.S. PATENT DOCUMENTS 4,028,985 A * 6/1977 Merritt ..... 84/454
5,817,963 A * 10/1998 Fravel et al. ..... 84/454
5,831,190 A * 11/1998 Trabucco, Jr. ..... 84/477 R
5,973,252 A * 10/1999 Hildebrand ..... 84/603
6,025,553 A * 2/2000 Lee ..... 84/610
6,066,790 A * 5/2000 Freeland et al. ..... 84/454
6,613,971 B1 * 9/2003 Carpenter ..... 84/454
6,627,806 B1 * 9/2003 Carpenter ..... 84/454
7,488,886 B2 * 2/2009 Kemp ..... 84/609
2004/0025672 A1 * 2/2004 Carpenter ..... 84/622
2005/0204898 A1 * 9/2005 Adams et al. ..... 84/454
2007/0012157 A1 * 1/2007 D'Addario ..... 84/304
2007/0234880 A1 * 10/2007 Adams et al. ..... 84/601

* cited by examiner

*Primary Examiner* — Marlon Fletcher
(74) *Attorney, Agent, or Firm* — Warner J. Delaune; Baker Donelson, et al.

(57) ABSTRACT

A vocal tuning device for use with a microphone is provided, comprising a housing having a first end and a second end, wherein the first end includes a first connector operably matable with a microphone and capable of receiving an input signal from the microphone in response to a user's voice; a display on the housing capable of providing a visual indicia to a user; processing circuitry within the housing and operably connected between the first connector and the display, wherein the processing circuitry compares the frequency of the input signal to a natural note frequency, and causes the visual indicia to indicate whether the natural note frequency is matched by the frequency of the input signal. In one embodiment, the second end of the device includes a second connector operably matable with a microphone cable.

10 Claims, 2 Drawing Sheets

VOCAL TUNING DEVICE FOR MICROPHONES

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON COMPACT DISC

Not applicable.

BACKGROUND OF THE INVENTION

1. Field of the Invention

The present invention relates to devices used to display the pitch of a person's voice, and more particularly to such devices which can be attached to a microphone and provide a discreet display of whether the pitch of a person's singing voice during a musical practice or performance is on key.

2. Description of Related Art

Tuning devices are widely used to measure and adjust the pitch of a sound of a music instrument. Similar tuning devices may also be used to detect the pitch of a singer's voice. In the case of tuners for musical instruments, the tuner measures a frequency of a musical sound to allow the user to adjust the sound to a predetermined frequency. In the case of tuning devices for vocalized sounds, the singer can see the displayed pitch and adjust his voice accordingly to match the predetermined frequency or note. However, tuning devices for singers are typically large, non-portable devices which are connected to other equipment, or they might be small and portable devices, but which are not particularly helpful or discrete enough for live performances.

Ordinarily, the tuning device interacts with a microphone which is connected to the tuning device by means of a signal cable. The microphone detects the sound coming from the singer, and the resultant signal may be amplified prior to entering the tuning device. In the case of wireless microphones, the signal is similarly transmitted to the tuning device, although with the convenience of permitting the singer greater mobility.

Regardless of the arrangement, the display of the tuner is generally difficult to see at a distance, because the lights or other alphanumeric display is too small to be perceived, particularly while moving quickly during a live performance. In addition, singers in live performances are constantly facing the audience, making placement of such a tuning device virtually impossible. Thus, singers must use their own judgment and experience to dynamically assess whether their singing pitch is correct or on key, often times adjusting their voice to match the tone of instruments played by other performers. Accordingly, there is a need for a new vocal tuning device that can be easily viewed only by the singer during a live performance or rehearsal, and which can be integrated with conventional microphones. Such a tuning device would permit the singer to adjust the pitch of his voice in response to a visual display which detects the instantaneous voice frequency along with an alphanumeric indication of the note, as well as any flatness or sharpness thereof.

SUMMARY OF THE INVENTION

Therefore, a vocal tuning device for use with a microphone is provided, comprising a housing having a first end and a second end, wherein the first end includes a first connector operably matable with a microphone and capable of receiving an input signal from the microphone in response to a user's voice; a display on the housing capable of providing a visual indicia to a user; processing circuitry within the housing and operably connected between the first connector and the display, wherein the processing circuitry compares the frequency of the input signal to a natural note frequency, and causes the visual indicia to indicate whether the natural note frequency is matched by the frequency of the input signal. In one embodiment, the second end of the device includes a second connector operably matable with a microphone cable.

Optionally, the housing of the device further includes a wireless adaptor capable of communicating the input signal to sound reproduction equipment, such as an amplifier or speakers. In a more specific embodiment, the visual indicia indicates whether the frequency of the input signal is lower or higher than the natural note frequency, or the extent to which the frequency of the input signal is lower or higher than the natural note frequency, such as through the use of multiple gradations or levels of flatness or sharpness. Preferably, the visual indicia indicates the natural note closest in frequency to the frequency of the input signal.

In a common configuration in which a microphone cable is employed, the first connector is a female XLR connector, while the second connector is a male XLR connector, such that the tuning device is interconnected between the microphone and the microphone cable. Preferably, the visual indicia of the tuning device comprises one or more light emitting diodes (LED's). Optionally, the visual indicia comprises a first color displayed when the frequency of the input signal is matched to the natural note frequency, and a second color displayed when the frequency of the input signal is not matched to the natural note frequency. The tuning device should also contain processing circuitry which includes a noise gate capable of filtering sounds other than the user's voice.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

Figure 1:
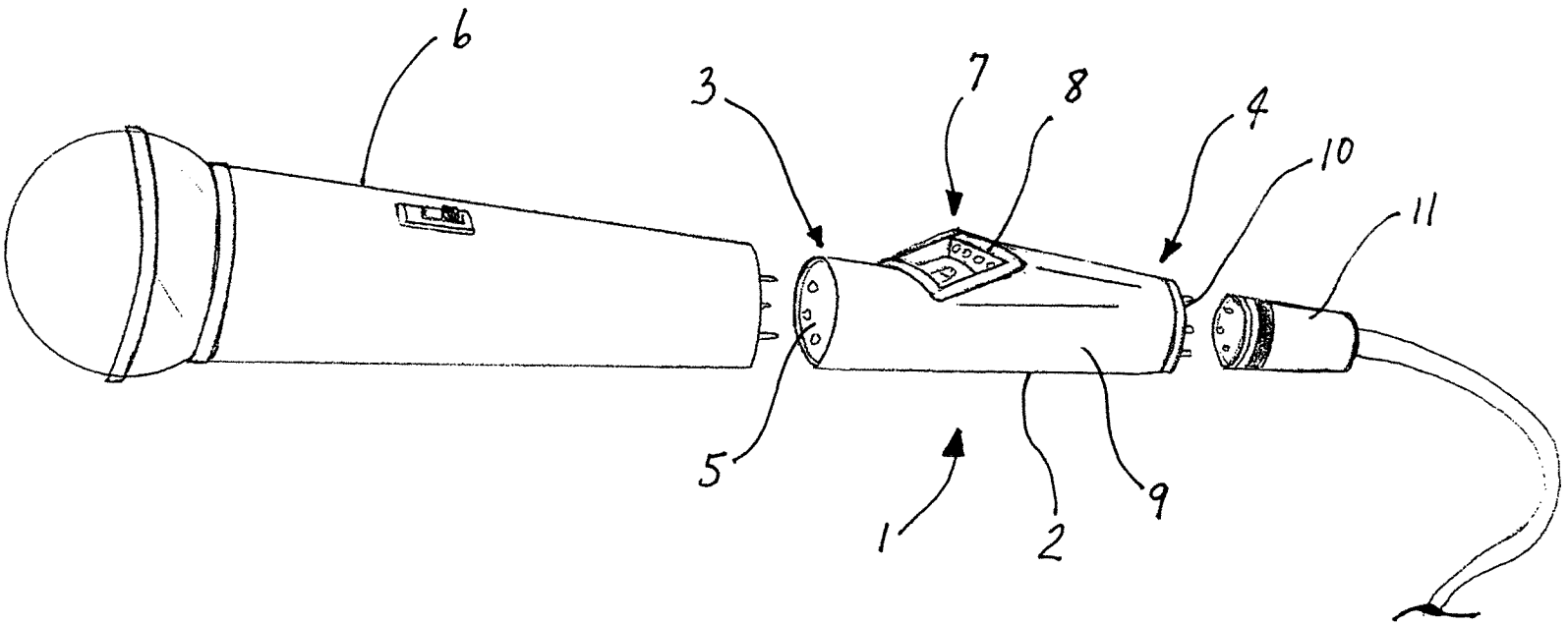
FIG. 1 shows a perspective view of a conventional microphone incorporating a preferred embodiment of the present invention.

Turning now to FIG. 1, a preferred embodiment of the invention 1 is shown to comprise a housing 2 having a first end 3 and a second end 4, wherein the first end 3 includes a first connector 5 operably matable with a conventional microphone 6 and capable of receiving an input signal from the microphone 6 in response to a user's voice. In a typical configuration, the housing 2 is generally cylindrical in shape, approximately 2-3 inches in length, and approximately 1.5 inches in diameter, although such dimensions can vary to suit particularly technical or aesthetic requirements. The materials used for the housing 2 may be metal or plastic, although the specific material for the demands of most situations is not critical. The first connector 5 is a common female XLR connector, but can also be any other connector used in the industry which is interoperable with the base end of the microphone 6. Similarly, the second end 4 of the device 1 includes a second connector 10 operably matable with a microphone cable 11, and will most often comprise a male XLR connector.

The housing 2 encloses processing circuitry 9 which is operably connected between the first connector 5 and the display 7, wherein the processing circuitry 9 compares the frequency of the input signal to a natural note frequency, and causes the visual indicia to indicate whether the natural note frequency is matched by the frequency of the input signal. While the specific details of such processing circuitry 9 are not provided herein, persons of ordinary skill in the art will appreciate that any such processing circuitry 9 common to conventional tuning devices described earlier would be suitable. Nonlimiting examples of such processing circuitry 9 may be those disclosed in U.S. Pat. Nos. 7,049,502; 5,817,963; 4,028,985; and many others, the disclosures of which are incorporated herein by reference. Power for the device 1 may be supplied by a separate battery, such as a conventional 9V battery, or through "phantom" power, typically 48V, sent from a mixing console.

Figure 2:
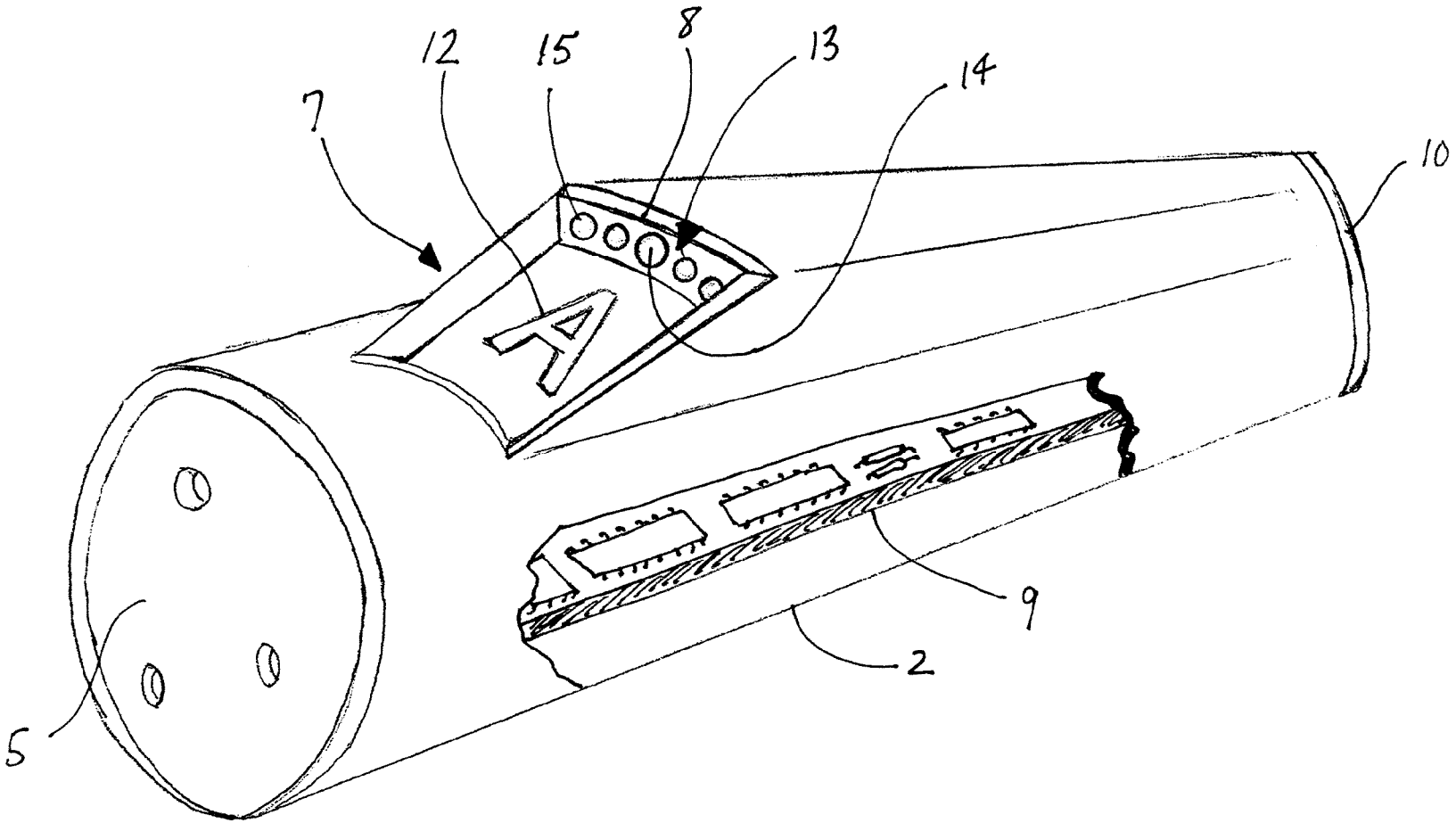
FIG. 2 shows a detail view of the embodiment of FIG. 1 depicting the display and visual indicia for the user.

The device 1 includes a display 7 on the housing 2 capable of providing a visual indicia 8 to a user. As shown more particularly in FIG. 2, the display 7 includes an angled and backlit digital display, such as an alphanumeric LCD display 12, which is capable of displaying a character corresponding to a natural note frequency. Preferably, the visual indicia 8 of the tuning device 1 comprises one or more light emitting diodes (LED's) 13. In the case of LED's 13 for the visual indicia 8, a primary LED 14 may illuminate as a first color, i.e. green, displayed when the frequency of the input signal is matched to the natural note frequency, and a second color, i.e. red, displayed when the frequency of the input signal is not matched to the natural note frequency. In the embodiment of FIG. 2, the LED's 13 may also include a plurality of secondary LED's 15 which are smaller then primary LED 14 and illuminated in a specific color when the pitch of the user's voice is flat or sharp. For example, if the pitch of the user's voice is slightly flat, then the primary LED 14 may not illuminate at all, but the secondary LED 15 immediately to the left of the primary LED 14 may illuminate in a red color. If the user's voice is substantially flat, then the left-most secondary LED 15 may illuminate in a red color. Similarly, if the pitch of the user's voice is slightly sharp, then the primary LED 14 may not illuminate at all, but the secondary LED 15 immediately to the right of the primary LED 14 may illuminate in a red color. If the user's voice is substantially sharp, then the right-most secondary LED 15 may illuminate in a red color. From the above description, it can be understood that the user is on key, i.e. is singing with precise pitch for the displayed note, when none of the secondary LED's 15 are illuminated, and the primary LED 14 is illuminated green. Optionally, the intensity levels of illumination of either the primary LED 14 or the secondary LED's 15 may be caused to vary as an additional indication of how close or distant the user's voice is from the natural note frequency. Of course, other variations and colors may be used to similarly indicate flat or sharp pitches, with the understanding that any such variations are within the scope of the invention.

As the user of such device I will likely be in an environment where other sound sources are present, as is typical during a live performance, the processing circuitry 9 should further include a noise gate or similar electronics capable of filtering sounds other than the user's voice.

It can be appreciated that such display 7 is only visible to the singer, which provides simultaneous benefits of being portable and discrete, while assisting the singer in adjusting his voice dynamically to achieve the best performance possible.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A vocal tuning device for use with a conventional performer's microphone, comprising:

(a) a housing having a first end and a second end, wherein the first end includes a first connector operably matable with a conventional performer's microphone and capable of receiving an input signal from the microphone in response to a user's voice, wherein the housing is adjacent to the microphone when the housing and the microphone are connected, and wherein the microphone and the housing may be held by a single hand of the user during a performance;

(b) a display on the housing capable of providing a visual indicia to the user;

(c) processing circuitry within the housing and operably connected between the first connector and the display, wherein the processing circuitry compares the frequency of the input signal to a natural note frequency, and causes the visual indicia to indicate whether the natural note frequency is matched by the frequency of the input signal; and (d) wherein the second end includes a second connector operably matable with a conventional microphone cable.

2. The device of claim 1, wherein the housing further includes a wireless adaptor capable of communicating the input signal to sound reproduction equipment.

3. The device of claim 1, wherein the visual indicia indicates whether the frequency of the input signal is lower or higher than the natural note frequency.

4. The device of claim 1, wherein the visual indicia indicates the extent to which the frequency of the input signal is lower or higher than the natural note frequency.

5. The device of claim 1, wherein the visual indicia indicates the natural note closest in frequency to the frequency of the input signal.

6. The device of claim 1, wherein the first connector is a female XLR connector.

7. The device of claim 3, wherein the visual indicia comprises one or more LED's.

8. The device of claim 3, wherein the visual indicia comprises a first color displayed when the frequency of the input signal is matched to the natural note frequency, and a second color displayed when the frequency of the input signal is not matched to the natural note frequency.

9. The device of claim 1, wherein the processing circuitry includes a noise gate capable of filtering sounds other than the user's voice.

10. The device of claim 1, wherein the second connector is a male XLR connector.

* * * * *